US007623016B2

(12) United States Patent
Shudarek et al.

(10) Patent No.: US 7,623,016 B2
(45) Date of Patent: Nov. 24, 2009

(54) SNAP TOGETHER MULTIPLE PHASE INDUCTOR ASSEMBLY

(75) Inventors: Todd A. Shudarek, West Bend, WI (US); Wesley Ruther, Fredonia, WI (US)

(73) Assignee: MTE Corporation, Menomonee Falls, WI (US)

( * ) Notice: Subject to any disclaimer, the term of this patent is extended or adjusted under 35 U.S.C. 154(b) by 601 days.

(21) Appl. No.: 11/146,462

(22) Filed: Jun. 7, 2005

(65) Prior Publication Data

US 2006/0279393 A1 Dec. 14, 2006

(51) Int. Cl.
*H01F 27/26* (2006.01)

(52) U.S. Cl. ..... 336/210

(58) Field of Classification Search ..... 336/5, 336/65, 90, 92, 170, 192, 210–212, 214–215
See application file for complete search history.

(56) References Cited

U.S. PATENT DOCUMENTS

| | | | | | |
|---|---|---|---|---|---|
| 1,669,929 | A | * | 5/1928 | Currier | 336/210 |
| 3,668,586 | A | * | 6/1972 | Horbach | 336/210 |
| 4,890,086 | A | * | 12/1989 | Hill | 336/210 |
| 4,899,122 | A | * | 2/1990 | Sommer | 336/65 |
| 4,951,024 | A | * | 8/1990 | Stelter et al. | 336/5 |
| 5,289,153 | A | * | 2/1994 | Gross | 336/210 |
| 6,060,975 | A | | 5/2000 | Rowe | |

* cited by examiner

*Primary Examiner*—Tuyen Nguyen
(74) *Attorney, Agent, or Firm*—Greenberg Traurig, LLP

(57) ABSTRACT

The magnetic core and electrical coils of a multiple phase inductor are held together by a non-magnetically permeable retainer. The retainer has a base with a cavity that receives the magnetic core and has U-shaped arms that form channels which guide and align the components during assembly. A retainer cap snaps onto the base in a manner that retains the core elements and electrical coils. An electrical terminal block also snaps onto the cap for easy assembly.

25 Claims, 2 Drawing Sheets

SNAP TOGETHER MULTIPLE PHASE INDUCTOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to inductors, such as those used in electrical filters, and more particularly to three-phase electrical inductors.

2. Description of the Related Art

Alternating current motors often are operated by motor drives in which both the amplitude and the frequency of the stator winding voltage are controlled to vary the rotor speed. In a normal operating mode, the motor drive switches voltage from a source to create an output voltage at a particular frequency and magnitude that is applied to drive the electric motor at a desired speed.

When the mechanism connected to the motor decelerates, the inertia of the that mechanism causes the motor to continue to rotate even if the electrical supply is disconnected. At this time, the motor acts as a generator producing electrical power while being driven by the inertia of its load. In a regenerative mode, the motor drive conducts that generated electricity from the motor to an electrical load, such as back to the supply used during normal operation. The regeneration can be used to brake the motor and its load. In other situations, the regenerative mode can be employed to recharge batteries or power other equipment connected to the same supply lines that feed the motor drive during the normal operating mode.

Electrical filters are often placed between the electric utility supply lines and the motor drive to prevent electricity at frequencies other than the nominal utility line frequency (50 Hz or 60 Hz) from being applied from the motor drive onto the supply lines. It is undesirable that such higher frequency signals be conducted by the supply lines as that might adversely affect the operation of other electrical equipment connected to those lines. In the case of a three-phase motor drive, a filter comprising one or more inductors and other components for each phase line has been used to couple the motor drive to the supply lines and attenuate the undesirable frequencies.

A conventional three-phase inductor has a structure similar to that disclosed in U.S. Pat. No. 6,060,975. The core of that inductor comprises a first section with an E-shape and a straight second section that extends across the exposed ends of the legs of the first section, thereby completing a magnetic circuit. Both sections are formed as laminations of a plurality of magnetically permeable plates A separate coil is provided for each electrical phase and is wound on a bobbin that is slid onto one of the legs of the E-shaped first core section. The separate sections of the core are held together by the bobbins that have tabs with bolts extending through holes in the tabs and in the core laminations. A three-phase inductor of this construction typically is assembled by hand and requires some amount of time to secure all the components with a plurality of bolts, washers and nuts.

Thus, it is desirable to provide a construction for a multiple phase inductor that is easier and faster to assemble.

SUMMARY OF THE INVENTION

An electrical inductor assembly has a core of magnetically permeable material on which a plurality of electrical coils are mounted. A base made of non-magnetically permeable material has a cavity in which the core is received. A cap, also fabricated of non-magnetically permeable material, is fastened to the base, thereby retaining the core in the cavity and retaining the plurality of electrical coils on the core.

In a three-phase embodiment of the electrical inductor assembly, the core is formed by two separate elements. A first core element has a cross member from which first leg, a second leg and a third leg project. A second core element extends across ends of the first, second and third legs that are remote from the cross member, thereby creating a magnetic circuit. A retainer base of non-magnetically permeable material provides a pocket into which the first core element is received. The retainer base has a first arm that extends along the first leg of the first core element and has a channel into which the first leg is received. A second arm of the retainer base extends along the third leg of the first core element and has another channel into which the third leg is received. Each of the first and second arms includes a first fastening component.

A first electrical coil has an aperture through which the first arm of the retainer base and the first leg of the first core element extend. A second electrical coil also has an aperture through which the second leg of the first core element extends. A third electrical coil with an aperture through which the second arm of the retainer base and the third leg of the first core element extend. A retainer cap includes second fastening components that engage the first fastening components of the first and second retainer base, thereby retaining the second core element adjacent the first core element and retaining the first, second and third electrical coils on the core.

In the preferred embodiment of the inductor assembly, the first and second fastening components are configured so that the base and cap snap together to simplify assembly. In addition the pocket and channel configuration of the base facilitate assembly by aligning the core and coils components.

The various embodiments of the inductor assembly also may include a terminal block secured to the retainer cap.

DETAILED DESCRIPTION OF THE INVENTION

The present invention is being described in the context of a three-phase inductor, however the novel concepts are applicable to inductors for other numbers of phases.

Figure 1:
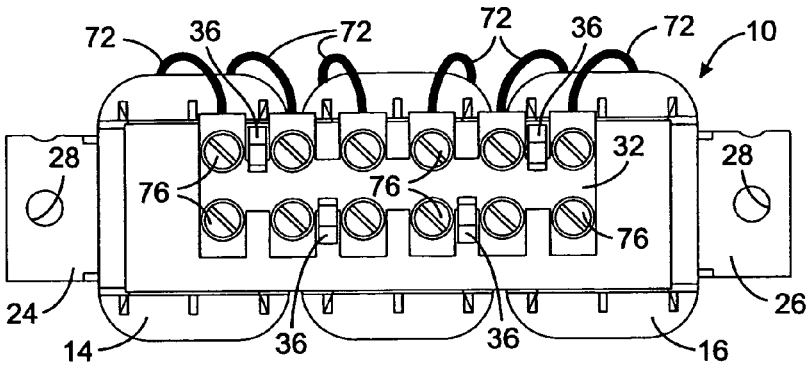
FIG. 1 is a top view of a three-phase inductor according to the present invention.
Figure 2:
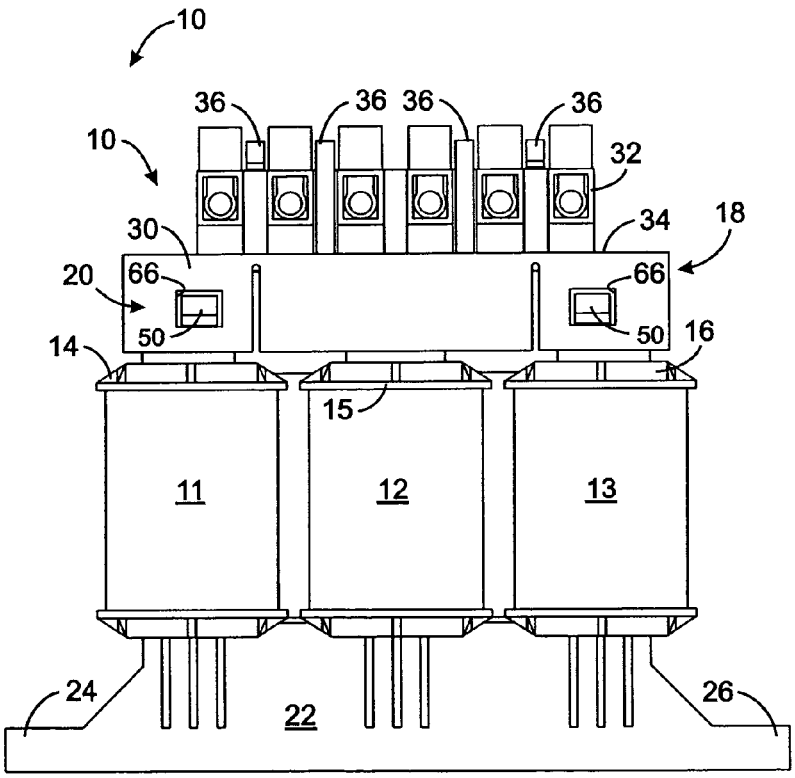
FIGS. 2 and 3 views of two sides of the three-phase inductor.
Figure 3:
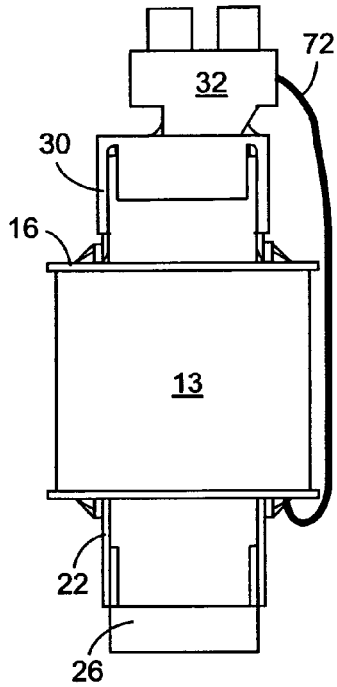

With initial reference to FIGS. 1-3, a three-phase inductor comprises three electrical coils 11, 12 and 13 of wire wound separate plastic bobbins 14, 15 and 16, respectively. The bobbins are mounted on a core 18 having elements that are formed of steel or other magnetically permeable material, as conventionally used for inductor and transformer cores. The core is held within a retainer 20 comprising a retainer base 22 that has a pair of flanges 24 and 26 that project laterally outward from opposite sides and which have apertures 28 therein for receiving a bolt or other fastener to mount the inductor. The retainer 20 also includes a retainer cap 30 that extends across and is fastened to the upper section of the retainer base 22 above the three coils 11-13. Both the retainer base and the retainer cap are made of plastic or other non-magnetically permeable material.

As used herein, the term "magnetically permeable material" means a material that is commonly used for the cores of inductors and transformers to conduct magnetic flux, and the term "non-magnetically permeable material" means a material that is an insulator with respect to magnetic flux. For example, a magnetic permeable material may have a magnetic permeability that is at least 1000 times greater than the permeability of air, and a non-magnetic permeable material may have a magnetic permeability that is less than 100 times the permeability of air.

A terminal block 32 is mounted on the top surface 34 of the retainer cap 30 and is held thereon by pairs of fingers 36 on opposite sides of the retainer cap 30 with each finger having a tooth that snaps above the terminal block to secure it in place. The terminal block 32 contains electrical terminals that receive the wires leading to each of the three electrical coils 11-13 and also provides terminals to connect an external electrical circuit to those wires and thus to the respective coils.

Figure 5:
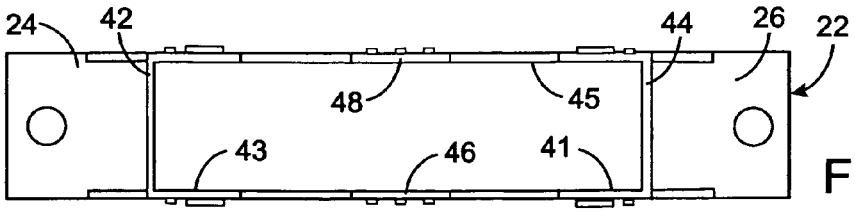
FIG. 5 is a top view of a retainer base of the three-phase inductor.
Figure 4:
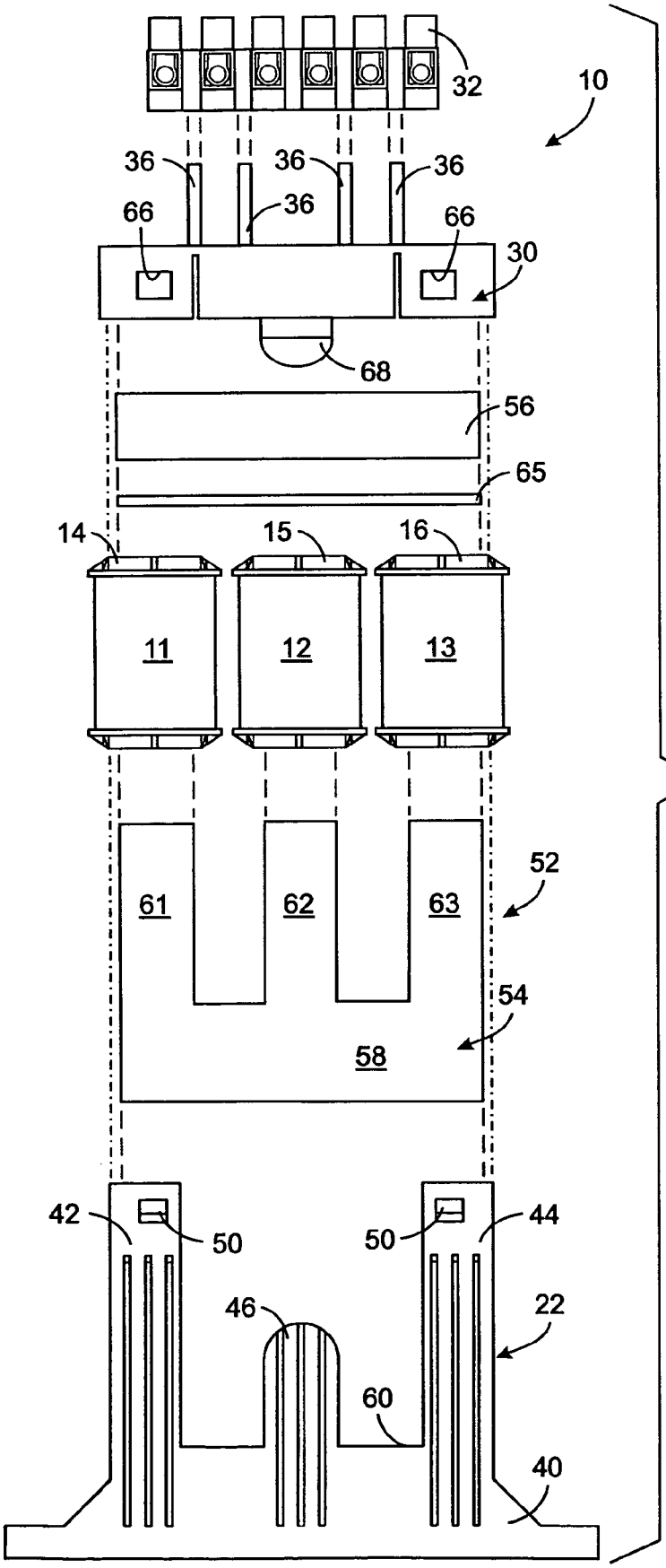
FIG. 4 is an exploded view illustrating the components of the three-phase inductor.

With reference to FIGS. 4 and 5, the retainer base 22 comprises a body 40 from which a first arm 42 with a U-shaped cross-section projects upward, thereby forming a first vertical channel 41 near one end of the retainer base. A second channel arm 44 also having a U-shaped cross-section projects upward from the body 40 forming a second channel 43 near the opposite end of the retainer base 22. The two channels 41 and 43 have openings that face one another which form a pocket 45 that extends downward into the body 40 for receiving a portion of the core 18, as will be described. The channels 41 and 42 and the pocket 45 define a cavity in the retainer base 22 for holding the core 18. In one alternative variation of the retainer base 22, the pocket is eliminated and the base has a flat body 40 with the arm channels acting as the cavity that holds the core 18. In another variation, the arms are a single flat strip the projects along edges of the core which sits in the pocket 45 of the base retainer base 22. One of ordinary skill in the art will appreciate that many additional variations of the present retainer assembly exist within the present inventive concept disclosed herein.

Figure 6:
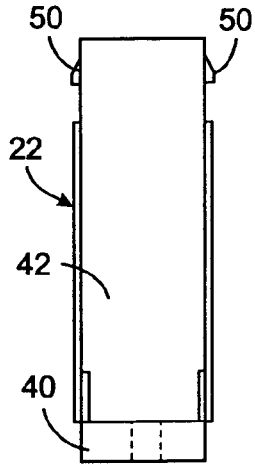
FIG. 6 is an elevational view of an end of the retainer base.

A short, planar tab 46 or 48 projects upward from each longitudinal side of the retainer base body 40 and is centered between the two channel arms 42 and 44. The exterior side surfaces of each channel arm 42 and 44 have a tooth 50 that projects outwardly therefrom to form a first fastening component. Each tooth, as shown in FIG. 6, has a tapered upper surface with a lower edge that extends orthogonally from the side surface of the respective arm to provide a latch mechanism for securing the retainer cap 30 to the retainer base 22, as will be described.

The core 52 of the inductor 10 comprises a first element 54 and a second element 56 both formed as a lamination of a plurality of plates of a relatively high magnetically permeable material. The first element 54 has an E-shape with a cross member 58 from which three legs 61, 62 and 63 project upwardly, in the orientation of the core in FIG. 4. The first core element 54 is adapted to slide along the channels 41 and 43 in the U-shaped arms 42 and 44 and then into the pocket 45 formed in the retainer base 22.

The inductor 10 is assembled by initially inserting the E-shaped first core element 54 into the pocket 45 of the retainer base 22. This positions the first core element 54 so that its first leg 61 lies within the first arm 42 of the retainer base 22 and the third core leg 63 is within the second arm 44. The middle leg 62 of the first core element 54 aligns with the central tabs 46 and 48 of the retainer base 22. Then, the electrical coils 11-13 are placed onto the retainer 20. Specifically, the first electrical coil 11, after being wound onto its bobbin 14, is slid onto the retainer base first arm 42 and thus also onto the first core leg 61. The second electrical coil 12 and its bobbin are dropped onto the second core leg 62 and over the tabs 46 on the retainer base 22. The electrical coil 13 and its bobbin 14 are slid onto the second arm 44 of the retainer base, and thus also around the third core leg 63. The two retainer base arms 42 and 44 extend entirely through openings in the bobbins 14 for the respective electrical coil. The coils 11-13 so positioned on the retainer base 22 abut the upper edge 60 of the body 40.

Thereafter, a spacer plate 65 of non-magnetically permeable material is placed against the exposed ends of the legs 61-63 of the first core element 54. For example, the spacer may be a synthetic aramid polymer, such as is available under the brand name NOMEX® from E. I. du Pont de Nemours and Company of Wilmington, Del. U.S.A. The second core element 56, in the form of a rectangular bar of a magnetically permeable material, is placed against the spacer plate 65 so that the spacer plate separates the two core elements 54 and 56. The second core element 56 also fits within the channels 41 and 43 in the two arms 42 and 44.

With continuing reference to FIG. 4, the retainer cap 30 is next placed onto the exposed ends of the channel arms 42 and 44. The retainer cap 30 has a rectangular box-shape with a open bottom that receives the second core element 56 and the upper ends of the channel arms. A tab 68 projects downward from the middle of the lower edge on each side of the retainer cap 30 and those tabs 68 enter the central opening of the middle, second coil 12. The teeth 50 on the ends of the channel arms 42 and 44 slide against inner surfaces of the retainer cap body 64 and snap into rectangular apertures 66 on the sides of that cap, wherein each aperture forms a second fastening element. The engagement of the teeth 50 with the apertures 66 secures the retainer cap 30 to the retainer base 22, thus retaining the core 52 and electrical coils 11-13 as an inductor assembly.

Figure 7:
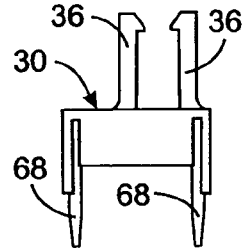
FIG. 7 is an end view of the retainer cap of the three-phase inductor.

Four resilient fingers 36 project upwardly from the top surface of the retainer cap 30. The fingers are arranged in two rows, each having two fingers, with a gap between the two rows, as shown in FIG. 7. Each finger 36 has a tooth 70 facing inward toward the other row of fingers. With reference to FIG. 1, the terminal block 32 has grooves through which the fingers slide when the terminal block is inserted onto the top of the retainer cap 30. When the terminal block has been fully inserted, the teeth 70 on the fingers 36 snap over an upper surface of the terminal block, thereby securing it to the retainer cap 30. After the terminal block 32 has been secured, wires 72 extending from the three coils 11-13 are connected to electrical terminals by connector screws 76.

Thus, the retainer base 22 provides a mechanism that self aligns the core and coil components which greatly facilitates and hastens assembly of the inductor 10. The components of the three-phase inductor 10 slide together with the retainer cap 30 snapping onto retainer base 22 to hold the assembled components in place. The terminal block 32 also snaps onto the fingers 36 that extend from the terminal cap. The snap-type interlocking of the components eliminates the previous time consuming process of fastening the inductor components with bolts, washers and nuts.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. An electrical inductor assembly comprising:

a core of magnetically permeable material;

at least one electrical coil mounted on the core; and a retainer of non-magnetically permeable material, wherein the retainer comprises a base and a cap, wherein the base has a cavity in which the core is received, and the cap is fastened to the base thereby retaining the core in the cavity and retaining each electrical coil on the core;

wherein the base has a body from which a plurality of arms extend along the core; and wherein each of the plurality of arms extends through one of the at least one electrical coil.

2. The electrical inductor assembly as recited in claim 1 wherein the cap is secured to the plurality of arms of the base.

3. The electrical inductor assembly as recited in claim 1 wherein the base includes a first fastening component; and the cap includes a second fastening component that engages the first fastening component to secure the base and the cap together.

4. The electrical inductor assembly as recited in claim 1 further comprising a snap fastener that secures the cap to the base.

5. The electrical inductor assembly as recited in claim 1 further comprising an electrical terminal block secured to the cap.

6. The electrical inductor assembly as recited in claim 5 wherein the cap has a plurality of fingers that engage and hold the electrical terminal block onto the cap.

7. An electrical inductor assembly comprising:

a core of magnetically permeable material having a plurality of legs;

a plurality of electrical coils each having an aperture through which one of the plurality of legs extends;

a retainer base of non-magnetically permeable material with a pocket in which the core is received and having at least two arms that extend through respective apertures in at least two of the plurality of electrical coils; and a retainer cap fastened to the at least two arms of the retainer base thereby retaining the core in the pocket and retaining the plurality of electrical coils on the core.

8. The electrical inductor assembly as recited in claim 7 wherein each of the at least two arms of the retainer base includes a first fastening component; and the retainer cap includes a plurality of second fastening components that mate with and engage the first fastening components to secure the retainer base and the retainer cap together.

9. The electrical inductor assembly as recited in claim 8 wherein one of the first fastening component and the second fastening component comprises a tooth.

10. The electrical inductor assembly as recited in claim 7 further comprising a snap fastener that secures the retainer cap to the retainer base.

11. The electrical inductor assembly as recited in claim 7 wherein the retainer cap has another pocket into which the core is received.

12. The electrical inductor assembly recited in claim 7 wherein the core comprises:

a first core element with a cross member from which the plurality of legs project; and a second core element spaced from and extending across the plurality of legs.

13. The electrical inductor assembly as recited in claim 7 further comprising a terminal block secured to the retainer cap.

14. An electrical inductor assembly comprising:

a core of magnetically permeable material having a plurality of legs;

a plurality of electrical coils each having an aperture through which one of the plurality of legs extends;

a retainer base of non-magnetically permeable material having at least two arms each forming a channel in which the core is received, wherein the at least two arms extend through respective apertures in at least two of the plurality of electrical coils; and a retainer cap fastened to the at least two arms of the retainer base thereby retaining the core on the retainer base and retaining the plurality of electrical coils on the core.

15. The electrical inductor assembly as recited in claim 14 wherein each of the at least two arms of the retainer base includes a first fastening component; and the retainer cap includes a plurality of second fastening components that mate with and engage the first fastening components to secure the retainer base and the retainer cap together.

16. The electrical inductor assembly as recited in claim 15 wherein one of the first fastening component and the second fastening component comprises a tooth; and the other of the first fastening component and the second fastening component comprises an aperture.

17. The electrical inductor assembly as recited in claim 14 further comprising a snap fastener that secures the retainer cap to the retainer base.

18. The electrical inductor assembly recited in claim 14 wherein the core comprises:

a first core element with a cross member from which the plurality of legs project; and a second core element spaced from and extending across the plurality of legs.

19. A electrical inductor assembly comprising:

a first core element of magnetically permeable material having a first leg, a second leg and a third leg all of which project from a cross member;

a second core element of magnetically permeable material extending across ends of the first, second and third legs that are remote from the cross member;

a retainer base of non-magnetically permeable material with a cavity in which the first core element is received, and having a first arm extending along the first leg of the first core element and having a second arm extending along the third leg of the first core element, wherein each of the first and second arms includes a first fastening component;

a first electrical coil with an aperture through which the first arm of the retainer base and the first leg of the first core element extend;

a second electrical coil with an aperture through which the second leg of the first core element extends;

a third electrical coil with an aperture through which the second arm of the retainer base and the third leg of the first core element extend; and a retainer cap having fastening components that engage the first fastening component of the first and second arms of the retainer base, thereby retaining the second core element adjacent the first core element and retaining the first, second and third electrical coils on the first core element.

20. The electrical inductor assembly as recited in claim 19 wherein one of the first fastening component and the second fastening component comprises a tooth; and the other of the first fastening component and the second fastening component comprises a receiver for a tooth.

21. The electrical inductor assembly as recited in claim 19 further comprising a terminal block; and wherein the retainer cap has a plurality of fingers that engage and hold the terminal block against the retainer cap.

22. The electrical inductor assembly as recited in claim 19 wherein the retainer base further comprises a tab that extends into the second electrical coil.

23. The electrical inductor assembly as recited in claim 19 wherein the retainer cap further comprises a tab that extends into the second electrical coil.

24. The electrical inductor assembly as recited in claim 19 wherein each of the first and second arms form a channel into which the first and second core elements are received.

25. The electrical inductor assembly as recited in claim 19 wherein the retainer cap has another cavity into which the second core element is received.

* * * * *